United States Patent [19]

Hasimoto

[11] 4,127,314

[45] Nov. 28, 1978

[54] TERMINAL PIN HOLDING BLOCK

[75] Inventor: Susumu Hasimoto, Omiya, Japan

[73] Assignees: Nissan Motor Company, Limited, Yokohama; Kanto Seiki Company, Limited, Omiya, both of Japan

[21] Appl. No.: 810,680

[22] Filed: Jun. 27, 1977

[30] Foreign Application Priority Data

Jun. 30, 1976 [JP] Japan ..... 51-86448[U]

[51] Int. Cl.[2] ..... H01R 9/16; H01R 13/42

[52] U.S. Cl. ..... 339/59 M; 339/217 S

[58] Field of Search ..... 339/59 R, 59 M, 217 S

[56] References Cited

U.S. PATENT DOCUMENTS

| | | | |
|---|---|---|---|
| 3,686,619 | 8/1972 | McCardell et al. | 339/59 M |
| 3,982,805 | 9/1976 | Irie | 339/59 R |

*Primary Examiner*—Roy Lake
*Assistant Examiner*—E. F. Desmond
*Attorney, Agent, or Firm*—Lane, Aitken, Dunner & Ziems

[57] ABSTRACT

A terminal pin is held in a through passage of a housing to permit swingable play thereof in the passage, thereby securing snug connection of the pin with another terminal pin locked in another housing upon coupling of these two housings.

9 Claims, 6 Drawing Figures

TERMINAL PIN HOLDING BLOCK

The present invention relates in general to an electric connector for providing electrical connection between electric apparatus and more particularly to an electrical terminal pin holding block which constitutes substantially a half of the connector.

It is an object of the present invention to provide new and improved electrical terminal pin holding blocks, constituting an electric connector, in which the coupling of a block with another block is facilitated without sacrificing the essential electrical connection between the blocks.

It is another object of the present invention to provide new and improved terminal pin holding blocks in which the terminal pins are swingably but securely held in the block.

It is still another object of the present invention to provide new and improved terminal pin holding blocks which are simple in construction and easily fabricated and assembled thereby achieving low manufacturing cost of the blocks.

According to the invention, there is provided a terminal pin holding block for providing an electrical connection between apparatus when coupled with another terminal pin holding block, comprising a housing having a through passage bounded by a wall; a resilient tang extending from a portion of the wall to form a catch portion at its free end; a terminal pin formed with a recess which is adapted to receive therein the catch portion to hold the terminal pin against a first axial movement thereof with respect to the housing upon insertion of the pin into the passage; and means for holding the pin against a second axial movement of the same upon insertion of the pin into the passage, the second axial movement being opposite to the first axial movement, the assembling of the pin with the housing being such that the pin is permitted to swingably play by a predetermined amount in the passage even when the pin is held against the first and second axial movements.

Other objects and advantages of the present invention will become apparent from the following detailed description when taken in conjunction with the accompanying drawings, in which.

Prior to describing the construction of the new and improved electric connector of the subject invention, a description of the construction of the terminal pin holding block of the conventional connector will be given with the aid of FIG. 1 in order to clarify the inventive steps of the invention.

Figure 1:
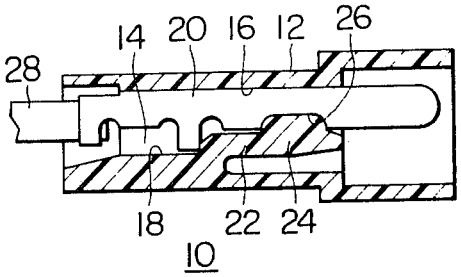
FIG. 1 PRIOR ART
FIG. 1 is a sectional view of a conventional electrical terminal pin holding block, the block being shown as having a male pin.

In FIG. 1, a block or a male pin holding block constituting a half of the conventional connector is shown as generally designated by a reference numeral 10. The block 10 generally comprises a housing 12 having at least one passage 14 therethrough which is bounded by a top wall 16, a bottom wall 18 and two side walls (no numerals). The passage 14 receives therein an electrical terminal pin or male pin 20. The bottom wall 18 has a resilient tang 22 integrally moulded thereon, which tang 22 is formed at the leading end portion thereof with a latching abutment 24. The male pin 20 has a recess 26 which receives therein the latching abutment 24 upon assembling of the block 10. Indicated by numeral 28 is a wire which is connected to an end of the pin 20. With this construction, the axial movements of the pin 20 with respect to the housing 12 are prevented, and furthermore, the downward movement of the pin 20 is also prevented by the upwardly acting force exerted by the resilient tang 22.

However, in the conventional connector employing such block 10, the following several drawbacks are encountered:

It occurs that, if the arrangement of the pin or pins in each block is not accurately or regularly made, the coupling and discoupling of the corresponding male and female pin holding blocks become very difficult because in such a state, large friction forces are inevitably produced between the contacting surfaces of the corresponding male and female parts during their connecting and disconnecting steps. In the worst case, the block may be broken. This undesirable phenomenon is more critically encountered in a case where a large number of terminal pins are mounted in each of the blocks.

Therefore, as stated before, the present invention contemplates to solve the above-mentioned problems encountered in the conventional connector employing such a block 10.

Figure 2:
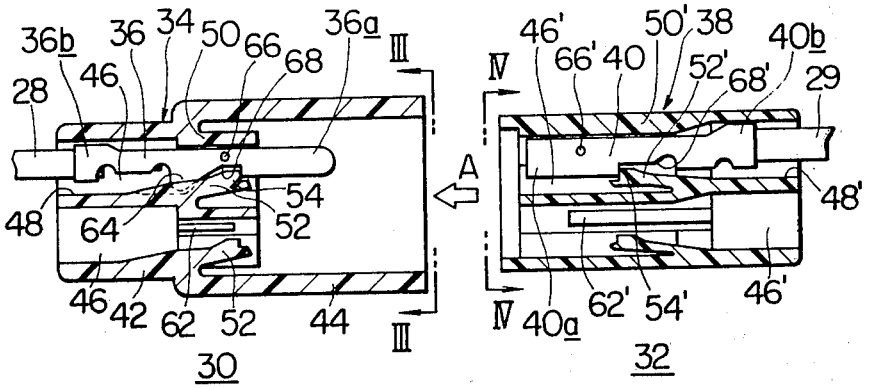
FIG. 2 is a detached sectional view of an electrical connector according to the present invention, the connector being shown as including a male pin holding block (left) and a female pin holding block (right)
Figure 3:
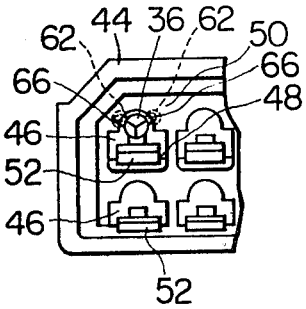
FIG. 3 is a partial view taken along the line III—III of FIG. 2.
Figure 4:
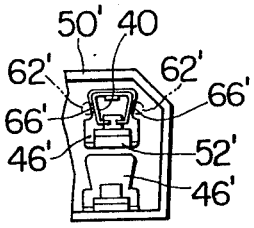
FIG. 4 is a partial view taken along the line IV—IV of FIG. 2.

Referring to FIG. 2, there is shown a new and improved electric connector which includes a male pin holding block 30 (left) and a female pin holding block 32 (right). The block 30 generally comprises a housing 34 and a plurality of tubular male pins 36 held in the housing 34 in two lines as shown in FIG. 3. The block 32, similar to the block 30, comprises a housing 38 and a plurality of tubular female pins 40 held in the housing in a double line as shown in FIG. 4. Each of the housings 34 and 38 is preferably of one piece construction and constructed of molded plastics.

Figure 5:
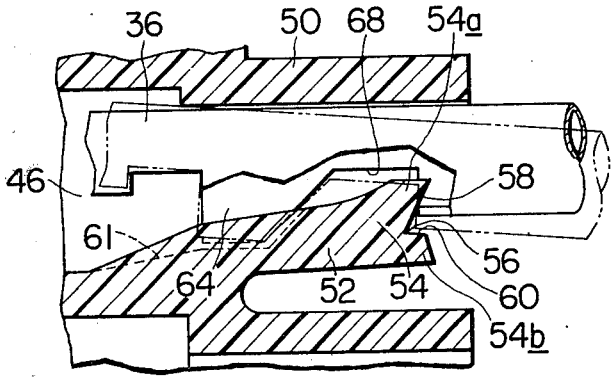
FIG. 5 is a fragmentary, partially sectional enlarged view of the male pin holding block shown in FIG. 2.

The male pin holding housing 30 includes a main housing section 42 and an enlarged extension section 44. The extension section 44 is integrally attached to the main housing section 42 for protecting male fitting ends **36*a* of the male pins projected thereinto and for detachably connecting the housing 30 to the female pin holding block 32 in a manner which will be described hereinlater. As shown, the main housing section 42 includes a plurality of elongate parallel passages 46 which are arranged in a double line. Since these passages 46 are substantially identical with one another, only the construction of the passage which holds therein the illustrated male pin 36 will be hereinafter described. The passage 46 is bounded by a wall 48 which is formed with an inwardly projected portion 50 at a portion thereof connected to the extension section 44. As shown in FIG. 3, the passage positioned in the projected portion 50 is formed to have a half-cylindrical upper portion. Extending from the bottom of the wall 48** is a resilient tang 52 which is integrally moulded on the wall 48 and is formed at its leading or free end with a catch portion 54. As best seen in FIG. 5, the catch portion 54 is formed with a recess 56 which divides the catch portion into an upwardly projecting section 54*a* and a laterally projecting section 54*b*. For the reason which will be explained later, an angle defined by a surface 58 of the section 54*a* in its rest position and the axis of the passage 46 is acute as shown. Indicated by numeral 60 is a surface of the projection 54*b*. As indicated by a dotted line 61, the resilient tang 52 is formed, at its connection with the bottom of the wall 48, with two first elongate grooves which extend parallel with the axis of the passage 46. Furthermore, two second elongated grooves 62 are formed in respective side walls of the passage 46 positioned in the inwardly projected portion 50 of the main housing section 42 in such a manner that the grooves 62 extend parallel with the axis of the passage 46. As will be well described hereinlater, the first and second grooves 61 and 62 are adapted to receive therein corresponding projections provided on the pin 36 for guiding and/or holding the pin 36 in the housing 34.

The male pin 36 includes a male fitting end 36*a* which is snugly inserted into the female pin 40 equipped in the female pin holding block 32 upon connection of these two blocks 30 and 32, and a wire connecting end 36*b* connected with a wire 28 by pressed sleeves or other suitable means. The male pin 36 has two first projections 64 which extend downwardly from a generally middle portion of the pin 36, and two second projections or stubs 66 which are firmly fixed to cylindrical side wall portions of the pin 36 to extend radially outwardly. These projections 64 and stubs 66 are respectively received in the before-mentioned first and second grooves 61 and 62 upon insertion of the pin 36 into the passage 46. For simplifying the drawing, the groove corresponding to the illustrated stub 66 is not shown in FIG. 2. However, the manner of the engagement of the grooves 62 with the stubs 66 will be well understood from FIG. 3. The male pin 36 is furthermore formed at a position under the stubs 66 with an opening or recess 68 which is sized to receive therein the before-mentioned upwardly projected section 54*a* of the resilient catch portion 54.

According to the present invention, the following contrivances are further required in the male holding block 30. First, the distance between the surface 60 of the laterally projecting portion 54*b* in the rest state of the resilient tang 52 and the top surface of the passage 46 located in the inwardly projected portion 50 is considerably greater than the outer diameter of the pin 36 adjacent the recess 68. Second, the radius of curvature of the half-cylindrical upper portion of the passage 46 positioned in the projected portion 50 is considerably larger than that of the pin 36.

The female pin holding housing 38, similar to the previously described male pin holding housing 34, is also formed with a plurality of enlongate parallel passages 46′ arranged in a double line as best seen in FIG. 4. Each of the passages 46′ is bounded by a wall 48′ which is formed with an inwardly projected portion 50′. As shown in FIG. 4, each passage 46′ located in the projected portion 50′ is formed to have at its upper portion a trapezoidal cross section. Extending from the bottom of the wall 48′ is a resilient tang 52′ which is integrally molded on the wall 48′ and is formed at its leading or free end with a catch portion 54′. The catch portion 54′ is substantially identical with the catch portion 54 of the above-mentioned male pin holding housing 34. A pair of elongated grooves 62′ are formed in side walls of the passage 46′ positioned in the inwardly projected portion 50′ to extend parallel with the axis of the passage 46′. The grooves 62′ are for receiving therein corresponding projections formed on the female pin 40 for steadily holding the same in the housing 38.

The female pin 40 further includes a female fitting end 40*a* to snugly receive therein the before-mentioned male fitting end 36*a*, and a wire connecting end 40*b* for a wire 29. The female pin 40 is provided with two projections or stubs 66′ which are firmly fixed to side walls of the pin 40. These stubs 66′ are slidingly received in the grooves 62′ upon insertion of the pin 40 into the passage 46′. For simplification of the drawing, the grooves corresponding to the illustrated stubs 66′ are not shown in FIG. 2, but the manner of engagement between the stubs 66′ and the grooves 62′ will be well understood from FIG. 4. The female pin 40 also has an opening or recess 68′ having the same function as in the case of the male pin 36.

Explanation of assembling the terminal pin holding blocks will be given. Since both of the blocks 30 and 32 are substantially identical in assembling process, only the process for the male pin holding block 30 will be described hereafter with reference to FIGS. 2 and 5. The male fitting end 36*a* of the male pin 36 is inserted from the left open side of the housing 34 into the passage 46 of the same and is moved axially to the right as viewed in FIG. 2. This movement is guided by the downward projections 64 and the stubs 66 which are respectively received in the first and second grooves 61 and 62. As the generally cylindrical fitting end 36*a* moves over the catch portion 54, the resilient tang 52 is depressed in a downward direction. However, as the fitting end 36*a* continues to be moved to the right, the recess 68 is finally disposed over the upwardly projected portion 54*a* of the catch portion 54, thus allowing the resilient tang 52 to return toward its original, substantially undepressed disposition. Thus, the upwardly projected portion 54*a* enters the recess 68 of the male pin 36 and the pin 36 is now held against leftward movement thereof. Upon this state, the upper portion of the upwardly projected portion 54*a* is projected into the interior of the pin 36 through the recess 68 due to provision of the inclined surface 58 as mentioned hereinbefore and thus such holding engagement is reliably and steadily made. At the same time, the stubs 66 are placed at the rightmost positions of their corresponding grooves 62 thus to hold the pin 36 against its rightward further movement. Under this condition, the pin 36 is prevented from rotation about its axis because of the engagement of the projections 64 and 66 with the grooves 61 and 62.

However, by the reasons mentioned hereinbefore in connection with the contrivances of the present invention, the male pin 36 is permitted to play swingably by a predetermined amount even in its secured state in the housing 34 as shown in FIG. 5.

In case of the female pin holding block 32, rightward further movement of the female pin 40 is prevented by the catch portion 54′ received in the recess 68′ of the pin 40, and leftward further movement of the same is prevented by engagement of the stubs 66′ with closed ends of the grooves 62′. Of course, in this block 32, the female pin 40 is permitted to swingably play even in its locked state in the housing 38 because of the same reasons mentioned before.

The male and female pin holding blocks 30 and 32 are then coupled together. To couple the blocks 30 and 32 together, one end of the housing 38 is snugly inserted into the enlarged extension section 44 of the housing 34 as indicated by the arrow A. This insertion will cause the male fitting end 36*a* of the male pin 36 to snugly enter the female fitting end 40*a* of the female pin 40. Now, it should be noted that, due to the swingable play of the male and female pin 36 and 40, such connecting or inserting operation of the corresponding parts is easily and reliably done without producing big friction force between the contacting surfaces of the corresponding parts. In fact, such big friction force has caused breaking of the pins in the conventional blocks as hereinbefore described.

Figure 6:
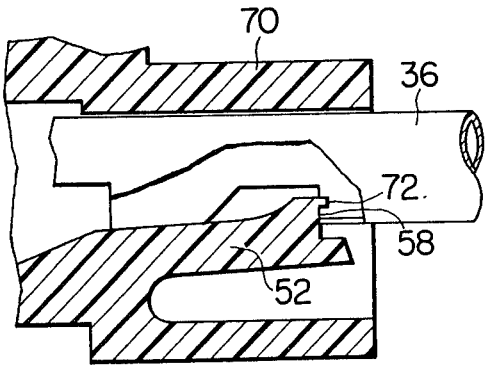
FIG. 6 is a view similar to FIG. 5, but showing an alternate embodiment of the present invention.

A slightly modified form of the male pin holding housing is partially shown in FIG. 6 as being designated by a reference numeral 70. As shown in this drawing, a laterally extending projection 72 is formed on the surface 58 of the upwardly projected section 54*a* of the catch portion 54. By this, the holding engagement between the pin 36 and the housing 70 is more reliably made. Of course, in this modified housing 70, the pin 36 is permitted to play swingably even when held in its secured state in the housing 70.

From the above, it will be appreciated that according to the present invention, the coupling process between the male pin holding block and the corresponding female pin holding block is reliably made with easy connecting work even when the pins in each block are not so accurately or so regularly arranged, furthermore the block of the invention can be made simple in construction and easily fabricated and assembled, thus inducing reduction in the manufacturing cost of the block.

It should be understood that the embodiments of the invention hereinabove described are shown to merely explain the principle of the subject invention. Various modifications and improvements are apparent to those skilled in the art without departing from the scope of the present invention which is only defined by the appended claims.

What is claimed is:

1. A terminal pin holding block for providing an electrical connection between apparatus when coupled with another terminal pin holding block, comprising:

a housing having a through passage bounded by a wall;

a resilient tang extending from a portion of said wall to form a catch portion at its free end;

a terminal pin formed with a recess which is adapted to receive therein said catch portion to hold said terminal pin against a first axial movement thereof with respect to said housing upon insertion of said pin in said passage;

means for holding said pin against a second axial movement of the same upon insertion of said pin in said passage, said second axial movement being opposite to said first axial movement;

said catch portion of said resilient tang including first and second projecting sections which are separated by a recessed portion, said first projecting section extending toward said recess of said terminal pin and engageable with the same, and said second projecting section extending substantially parallel with the axis of said pin supporting an outer surface of said pin with a flat surface thereof when said pin is depressed toward said second projecting section; and a predetermined amount of gap being formed between said flat surface of said second projecting section and said outer surface of said pin upon holding engagement of said catch portion with said recess for thereby allowing said pin to swing by a predetermined amount in said passage, the assembling of said pin with said housing being such that said pin is permitted to play swingably by a predetermined amount in said passage even when said pin is held against said first and second axial movement.

2. A terminal pin holding block as claimed in claim 1, in which said terminal pin is formed at one end thereof with a male fitting portion and at the other end thereof with a wire connecting portion.

3. A terminal pin holding block as claimed in claim 1, in which said terminal pin is formed at one end thereof with a female fitting portion and at the other end thereof with a wire connecting portion.

4. A terminal pin holding block as claimed in claim 1, in which said housing is provided with an integrated housing extension for protecting the end of said terminal pin previously installed therein and for connecting the housing proper to another terminal pin holding block.

5. A terminal pin holding block as claimed in claim 1, in which said first projecting section is formed with a flat surface which is engageable with a peripheral edge of said pin recess to hold said pin against the first axial movement.

6. A terminal pin holding block as claimed in claim 5, in which said flat surface of said first projection section is inclined so as to project at its leading end into the interior of said pin recess when said first projecting section is held in said recess.

7. A terminal pin holding block as claimed in claim 5, in which said flat surface of said first projecting section is provided at its leading end with a projection which is projected into the interior of said pin recess when said first projecting section is held in said recess.

8. A terminal pin holding block as claimed in claim 1, in which said holding means comprises at least one stub firmly fixed to an outer surface of said pin; and at least one elongated groove formed in said wall to extend substantially parallel with the axis of said passage, said groove being adapted to receive therein said stub to guide the pin under axial movements of the same in said passage and having a closed end thereof with which said stub is engaged for thereby locking said pin against the second axial movement of the same.

9. A terminal pin holding block as claimed in claim 8, in which said holding means further comprises at least one projection which integrally extends outwardly from said terminal pin, and at least one elongated groove formed in said resilient tang to extend substantially parallel with the axis of said passage, said groove being adapted to receive therein said projection to guide the pin upon insertion of said pin into said passage of said housing.

* * * * *